US006439954B1

(12) United States Patent
Walter et al.

(10) Patent No.: US 6,439,954 B1
(45) Date of Patent: Aug. 27, 2002

(54) WEIGHT TRANSFERRING SLED TOY

(76) Inventors: Lyle F. Walter, 1711 Olcott Rd., Marengo, IL (US) 60152; Judy Walter, 1711 Olcott Rd., Marengo, IL (US) 60152

( * ) Notice: Subject to any disclaimer, the term of this patent is extended or adjusted under 35 U.S.C. 154(b) by 68 days.

(21) Appl. No.: 09/633,567

(22) Filed: Aug. 4, 2000

(51) Int. Cl.[7] ..... A63H 17/05

(52) U.S. Cl. ..... 446/434; 446/466; 446/470; 73/862.03

(58) Field of Search ..... 446/434, 431, 446/465, 466, 470; 73/862.03

(56) References Cited

U.S. PATENT DOCUMENTS

| | | | | | |
|---|---|---|---|---|---|
| D185,497 | S | * | 5/1959 | Harriman | |
| 3,741,010 | A | * | 6/1973 | Luedtke | 73/862.03 |
| 4,296,840 | A | | 10/1981 | Payne | |
| 4,354,390 | A | | 10/1982 | Chamberlain | |
| 4,389,810 | A | * | 6/1983 | Green | 446/434 |
| 4,475,304 | A | * | 10/1984 | Goldfarb et al. | 446/465 |
| 4,571,211 | A | * | 2/1986 | Kuna | 446/434 |
| 4,615,223 | A | * | 10/1986 | Nause | 446/434 |
| D393,233 | S | | 4/1998 | Emanuel | |

* cited by examiner

*Primary Examiner*—Jacob K. Ackun
*Assistant Examiner*—Bera B. Miller

(57) ABSTRACT

A weight transferring sled toy for simulating a weight transfer sled used in truck and tractor pulls. The weight transferring sled toy includes a main body portion that has a main body base and a pair of tracks that extend upward from the main body base. A pair of wheels are coupled to a rear portion of the main body portion. An axle extends between the wheels and is coupled to the rear portion of the main body portion. An axle gear is coupled to a medial portion of the axle. A bar extends between a forward portion of the tracks. A drive chain extends between the bar and the axle gear such that rotation of the axle gear rotates the drive chain. A weight sled is positionable on the tracks. The weight sled has a hook member for engaging the drive chain whereby the weight sled is moved along the tracks when the wheels rotate and the hook member is engaged to the drive chain.

20 Claims, 2 Drawing Sheets

WEIGHT TRANSFERRING SLED TOY

BACKGROUND OF THE INVENTION

1. Field of the Invention

The present invention relates to simulated toys and more particularly pertains to a new weight transferring sled toy for simulating a weight transfer sled used in truck and tractor pulls.

2. Description of the Prior Art

The use of simulated toys is known in the prior art. More specifically, simulated toys heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,571,211; U.S. Pat. No. 4,475,305; U.S. Pat. No. 4,296,840; U.S. Pat. No. 4,354,309; U.S. Pat. No. 4,615,223; and U.S. Pat. No. Des. 393,233.

While these devices fulfill their respective, particular objectives and requirements, the aforementioned patents do not disclose a new weight transferring sled toy. The inventive device includes a main body portion that has a main body base and a pair of tracks that extend upward from the main body base. A pair of wheels are coupled to a rear portion of the main body portion. An axle extends between the wheels and is coupled to the rear portion of the main body portion. An axle gear is coupled to a medial portion of the axle. A bar extends between a forward portion of the tracks. A drive chain extends between the bar and the axle gear such that rotation of the axle gear rotates the drive chain. A weight sled is positionable on the tracks. The weight sled has a hook member for engaging the drive chain whereby the weight sled is moved along the tracks when the wheels rotate and the hook member is engaged to the drive chain.

In these respects, the weight transferring sled toy according to the present invention substantially departs from the conventional concepts and designs of the prior art, and in so doing provides an apparatus primarily developed for the purpose of simulating a weight transfer sled used in truck and tractor pulls.

SUMMARY OF THE INVENTION

In view of the foregoing disadvantages inherent in the known types of simulated toys now present in the prior art, the present invention provides a new weight transferring sled toy construction wherein the same can be utilized for simulating a weight transfer sled used in truck and tractor pulls.

The general purpose of the present invention, which will be described subsequently in greater detail, is to provide a new weight transferring sled toy apparatus and method which has many of the advantages of the simulated toys mentioned heretofore and many novel features that result in a new weight transferring sled toy which is not anticipated, rendered obvious, suggested, or even implied by any of the prior art simulated toys, either alone or in any combination thereof.

To attain this, the present invention generally comprises a main body portion that has a main body base and a pair of tracks that extend upward from the main body base. A pair of wheels are coupled to a rear portion of the main body portion. An axle extends between the wheels and is coupled to the rear portion of the main body portion. An axle gear is coupled to a medial portion of the axle. A bar extends between a forward portion of the tracks. A drive chain extends between the bar and the axle gear such that rotation of the axle gear rotates the drive chain. A weight sled is positionable on the tracks. The weight sled has a hook member for engaging the drive chain whereby the weight sled is moved along the tracks when the wheels rotate and the hook member is engaged to the drive chain.

There has thus been out lined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new weight transferring sled toy apparatus and method which has many of the advantages of the simulated toys mentioned heretofore and many novel features that result in a new weight transferring sled toy which is not anticipated, rendered obvious, suggested, or even implied by any of the prior art simulated toys, either alone or in any combination thereof.

It is another object of the present invention to provide a new weight transferring sled toy that may be easily and efficiently manufactured and marketed.

It is a further object of the present invention to provide a new weight transferring sled toy that is of a durable and reliable construction.

An even further object of the present invention is to provide a new weight transferring sled toy which is susceptible of a low cost of manufacture with regard to both materials and labor, and which accordingly is then susceptible of low prices of sale to the consuming public, thereby making such weight transferring sled toy economically available to the buying public.

Still yet another object of the present invention is to provide a new weight transferring sled toy which provides in the apparatuses and methods of the prior art some of the advantages thereof, while simultaneously overcoming some of the disadvantages normally associated therewith.

Still another object of the present invention is to provide a new weight transferring sled toy for simulating a weight transfer sled used in truck and tractor pulls.

Yet another object of the present invention is to provide a new weight transferring sled toy which includes a main body portion that has a main body base and a pair of tracks that extend upward from the main body base. A pair of wheels are coupled to a rear portion of the main body portion. An axle extends between the wheels and is coupled to the rear portion of the main body portion. An axle gear is coupled to a medial portion of the axle. A bar extends between a forward portion of the tracks. A drive chain extends between the bar and the axle gear such that rotation of the axle gear rotates the drive chain. A weight sled is positionable on the tracks. The weight sled has a hook member for engaging the drive chain whereby the weight sled is moved along the tracks when the wheels rotate and the hook member is engaged to the drive chain.

Still yet another object of the present invention is to provide a new weight transferring sled toy that is workable rather than just for display.

Even still another object of the present invention is to provide a new weight transferring sled toy that collectors will want.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set, forth above will become apparent when consideration is given to the following detailed description thereof. Such description makes reference to the annexed drawings wherein.

DESCRIPTION OF THE PREFERRED EMBODIMENT

Figure 1:
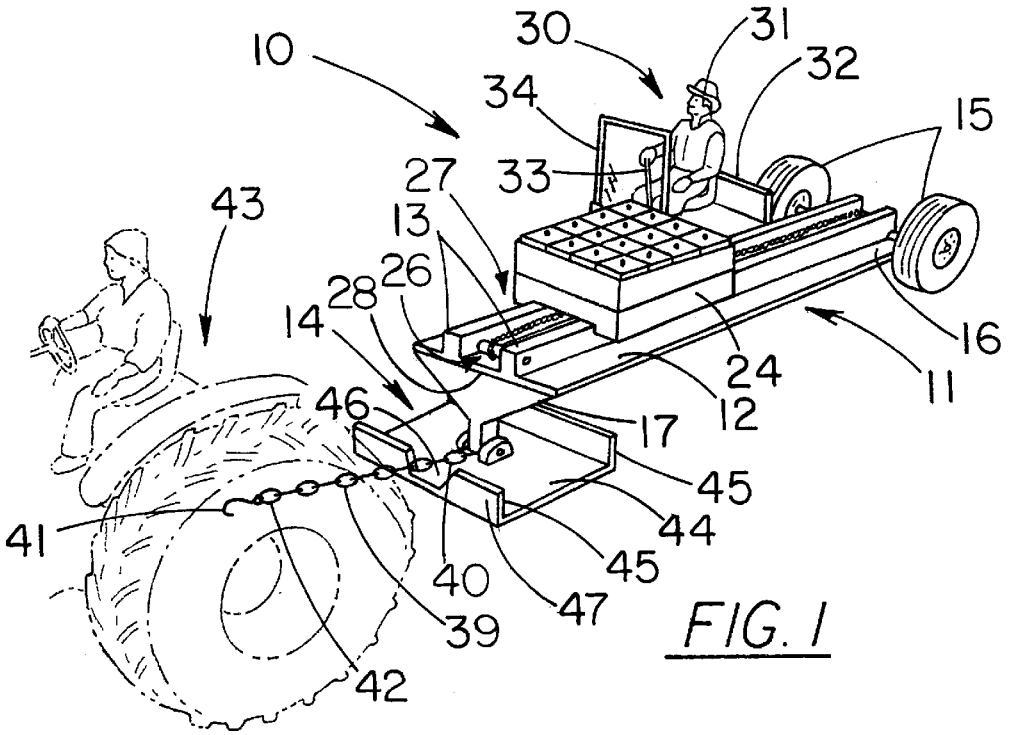
FIG. 1 is a schematic perspective view of a new weight transferring sled toy according to the present invention.
Figure 2:
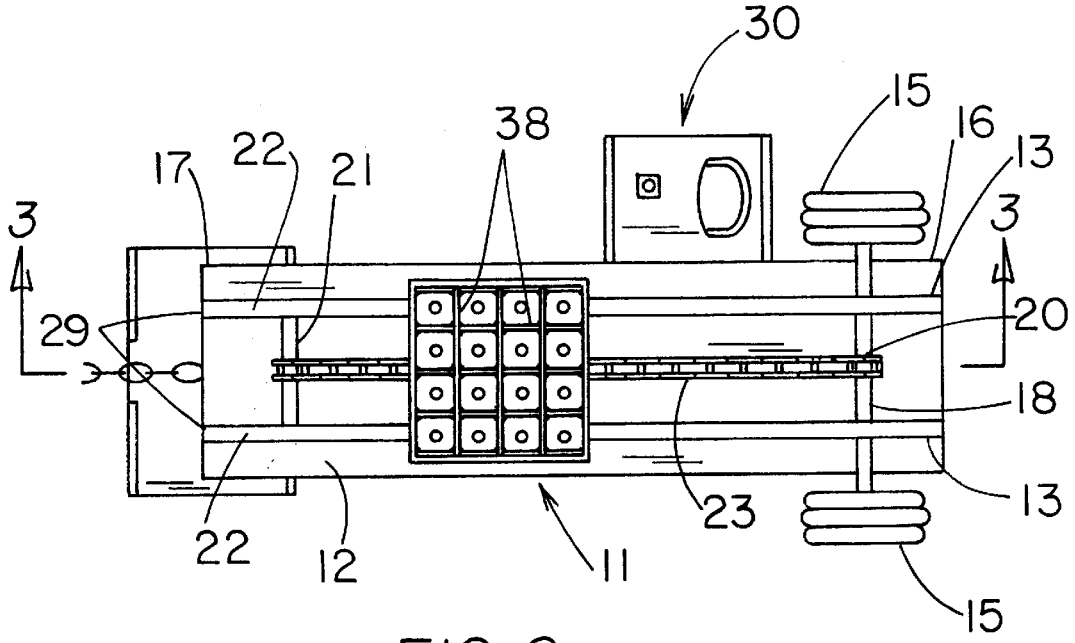
FIG. 2 is a schematic top view of the present invention.
Figure 3:
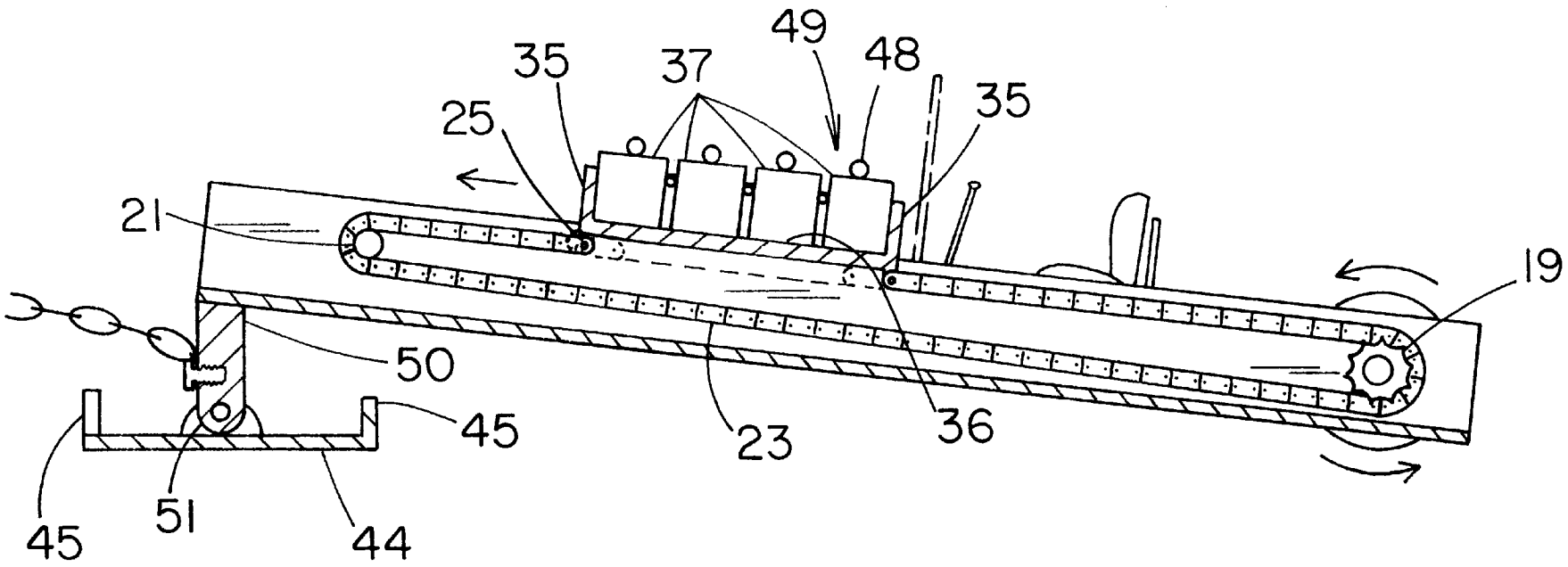
FIG. 3 is a schematic cross-section side view of the present invention.

With reference now to the drawings, and in particular to FIGS. 1 through 3 thereof, a new weight transferring sled toy embodying the principles and concepts of the present invention and generally designated by the reference numeral 10 will be described.

As best illustrated in FIGS. 1 through 3, the weight transferring sled toy 10 generally comprises a toy having a main body portion 11. The main body portion 11 has a main body base 12 and a pair of tracks 13 that extend upward from the main body base 12.

A runner 14 is coupled to a front portion 17 of the main body portion 11 and pair of wheels 15 are coupled to a rear portion 16 of the main body portion 11. An axle 18 extends between the wheels 15. The axle 18 is coupled to the rear portion 16 of the main body portion 11. An axle gear 19 is coupled to a medial portion 20 of the axle 18.

A bar 21 extends between a forward portion 22 of the tracks 13. A drive chain 23 extends between the bar 21 and the axle gear 19 such that rotation of the axle gear 19 rotates the drive chain 23.

A weight sled 24 is positioned on the tracks 13. The weight sled 24 has a hook member 25 that engages the drive chain 23. The weight sled 24 is moved along the tracks 13 when the wheels 15 rotate and the hook member 25 is engaged to the drive chain 23. The weight sled 24 has a central groove 26 that extends through a bottom 27 of the weight sled 24. The groove 26 is for receiving the tracks 13.

The hook member 25 is positioned proximate a forward edge 28 of the weight sled 24. In addition, the bar 21 is positioned in spaced relationship to a forward edge 29 of the tracks 13. This design allows the hook member 22 to disengage the drive chain 23 when the weight sled 24 passes over the bar 21 such that the hook member 22 becomes positioned between the bar 21 and the forward edge 29 of the tracks 13.

A simulated operator assembly 30 is coupled to the main body portion 11. The simulated operator assembly 30 includes, an operator chair 32, a set of simulated control mechanisms 33, and a window 34 positioned proximate the operator chair 32. A simulated human operator 31 is positioned in the operator chair 32.

A plurality of weights 37 are selectively positioned in the weight sled 24. The weight sled 24 has a perimeter wall 35 that extends upward from an upper surface 36 of the weight sled 24 to form a weight receptacle 49 for holding the weights 37. A plurality of dividing members 38 extend through the weight receptacle 25 for preventing the toppling of the weights 37 when the weights 37 are positioned in the weight receptacle 49. In addition, each of the weights 37 has a protrusion 48 that extends from an upper surface 49 of the weight 37 for facilitating grasping of the weight 37.

A connection chain 39 that has a proximal end 40 is coupled to the main body portion 11. A connection hook 41 is coupled to a distal end 42 of the connection chain 39 such that the main body portion 11 is adapted for coupling to a toy vehicle 43.

The runner 14 has a bottom plate 44 and pair of flanges 45 that extend upward from opposite sides of the bottom plate 44. The flanges 45 are positioned such that a longitudinal axis of each flange 45 extends transversely to a longitudinal axis of the main body portion 11. A forwardly positioned 47 one of the flanges 45 has a cutout portion 46 for preventing contact between the connection chain 39 and the forwardly positioned 47 one of said flanges 45 when the connection chain 39 is in a tightened condition. Moreover, a connection leg 50 extends downward from the main body portion 11. The runner 14 is pivotally coupled to a distal end 51 of the connection leg 50.

In use, a selected amount of weights 37 are placed in the weight sled 24. The connection chain 39 is then coupled to a toy vehicle 43. The toy vehicle 43 may then be moved. Movement of the toy vehicle moves the wheels 15 of the weight transferring sled toy 10. Movement of the wheels 15 in turn moves the drive change 23 and the weight sled 24 along the tracks 13. The weight sled 24 is moved along the tracks 13 until it reaches the forward edge 29 of the tracks 13. Once the weight sled 24 reaches the forward edge 29, the hook member 25 of the weight sled 24 disengages the drive chain 23.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A weight transferring sled toy comprising:

a toy having a main body portion, said main body portion having a main body base and a pair of tracks extending upwardly from said main body base;

a runner coupled to a front portion of said main body portion and pair of wheels coupled to a rear portion of said main body portion;

an axle extending between said wheels, said axle being coupled to said rear portion of said main body portion;

an axle gear coupled to a medial portion of said axle;

a bar extending between a forward portion of said tracks;

a drive chain extending between said bar and said axle gear such that rotation of said axle gear rotates said drive chain;

a weight sled positionable on said tracks, said weight sled having a hook member for engaging said drive chain whereby said weight sled is moved along said tracks when said wheels rotate and said hook member is engaged to said drive chain;

a simulated operator assembly coupled to said main body portion; and said simulated operator assembly including an operator chair, a set of simulated control mechanisms, and a window positioned proximate said operator chair.

2. The weight transferring sled toy of claim 1, further comprising:

said weight sled having a central groove extending through a bottom of said weight sled, said groove being for receiving said tracks.

3. The weight transferring sled toy of claim 1, further comprising:

said hook member being positioned proximate a forward edge of said weight sled;

said bar being positioned in spaced relationship to a forward edge of said tracks whereby said hook member disengages said drive chain when said weight sled passes over said bar.

4. The weight transferring sled toy of claim 1, further comprising:

a plurality of weights for selectively positioning in said weight sled.

5. The weight transferring sled toy of claim 4, further comprising:

said weight sled having a perimeter wall extending upwardly from an upper surface of said weight sled to form a weight receptacle for holding said weights.

6. The weight transferring sled toy of claim 4, further comprising:

each of said weights having a protrusion extending from an upper surface of said weight for facilitating grasping of said weight.

7. The weight transferring sled toy of claim 1, further comprising:

a connection chain having a proximal end coupled to said main body portion; and a connection hook coupled to a distal end of said connection chain such that said main body portion is adapted for coupling to a toy vehicle.

8. The weight transferring sled toy of claim 1, further comprising:

said runner having a bottom plate and pair of flanges extending upwardly from opposite sides of said bottom plate;

said flanges being positioned such that a longitudinal axis of each flange extends transversely to a longitudinal axis of said main body portion.

9. The weight transferring sled toy of claim 8, further comprising:

a connection chain having a proximal end coupled to said main body portion;

a connection hook coupled to a distal end of said connection chain such that said main body portion is adapted for coupling to a toy vehicle; and a forwardly positioned one of said flanges having a cutout portion for preventing contact between said connection chain and said forwardly positioned one of said flanges when said connection chain is in a tightened condition.

10. The weight transferring sled toy of claim 1, further comprising:

a simulated human operator positioned in said operator chair.

11. The weight transferring sled toy of claim 1, further comprising:

a connection leg extending downwardly from said main body portion; and said runner being pivotally coupled to a distal end of said connection leg.

12. A weight transferring sled toy comprising:

a toy having a main body portion, said main body portion having a main body base and a pair of tracks extending upwardly from said main body base;

a runner coupled to a front portion of said main body portion and pair of wheels coupled to a rear portion of said main body portion;

an axle extending between said wheels, said axle being coupled to said rear portion of said main body portion;

an axle gear coupled to a medial portion of said axle;

a bar extending between a forward portion of said tracks;

a drive chain extending between said bar and said axle gear such that rotation of said axle gear rotates said drive chain;

a weight sled positionable on said tracks, said weight sled having a hook member for engaging said drive chain whereby said weight sled is moved along said tracks when said wheels rotate and said hook member is engaged to said drive chain;

a plurality of weights for selectively positioning in said weight sled;

said weight sled having a perimeter wall extending upwardly from an upper surface of said weight sled to form a weight receptacle for holding said weights; and a plurality of dividing members extending through said weight receptacle for preventing toppling of said weights when said weights are positioned in said weight receptacle.

13. The weight transferring sled toy of claim 12, further comprising:

said weight sled having a central groove extending through a bottom of said weight sled, said groove being for receiving said tracks.

14. The weight transferring sled toy of claim 12, further comprising:

said hook member being positioned proximate a forward edge of said weight sled;

said bar being positioned in spaced relationship to a forward edge of said tracks whereby said hook member disengages said drive chain when said weight sled passes over said bar.

15. The weight transferring sled toy of claim 14, further comprising:

each of said weights having a protrusion extending from an upper surface of said weight for facilitating grasping of said weight.

16. The weight transferring sled toy of claim 12, further comprising:

a connection chain having a proximal end coupled to said main body portion; and a connection hook coupled to a distal end of said connection chain such that said main body portion is adapted for coupling to a toy vehicle.

17. The weight transferring sled toy of claim 12, further comprising:

said runner having a bottom plate and pair of flanges extending upwardly from opposite sides of said bottom plate;

said flanges being positioned such that a longitudinal axis of each flange extends transversely to a longitudinal axis of said main body portion.

18. The weight transferring sled toy of claim 17, further comprising:

a connection chain having a proximal end coupled to said main body portion;

a connection hook coupled to a distal end of said connection chain such that said main body portion is adapted for coupling to a toy vehicle; and a forwardly positioned one of said flanges having a cutout portion for preventing contact between said connection chain and said forwardly positioned one of said flanges when said connection chain is in a tightened condition.

19. The weight transferring sled toy of claim 12, further comprising:

a connection leg extending downwardly from said main body portion; and said runner being pivotally coupled to a distal end of said connection leg.

20. A weight transferring sled toy comprising:

a toy having a main body portion, said main body portion having a main body base and a pair of tracks extending upwardly from said main body base;

a runner coupled to a front portion of said main body portion and pair of wheels coupled to a rear portion of said main body portion;

an axle extending between said wheels, said axle being coupled to said rear portion of said main body portion;

an axle gear coupled to a medial portion of said axle;

a bar extending between a forward portion of said tracks;

a drive chain extending between said bar and said axle gear such that rotation of said axle gear rotates said drive chain;

a weight sled positionable on said tracks, said weight sled having a hook member for engaging said drive chain whereby said weight sled is moved along said tracks when said wheels rotate and said hook member is engaged to said drive chain;

said weight sled having a central groove extending through a bottom of said weight sled, said groove being for receiving said tracks;

said hook member being positioned proximate a forward edge of said weight sled;

said bar being positioned in spaced relationship to a forward edge of said tracks whereby said hook member disengages said drive chain when said weight sled passes over said bar;

a simulated operator assembly coupled to said main body portion;

said simulated operator assembly including an operator chair, a set of simulated control mechanisms, and a window positioned proximate said operator chair;

a plurality of weights for selectively positioning in said weight sled;

said weight sled having a perimeter wall extending upwardly from an upper surface of said weight sled to form a weight receptacle for holding said weights;

a plurality of dividing members extending through said weight receptacle for preventing toppling of said weights when said weights are positioned in said weight receptacle;

a connection chain having a proximal end coupled to said main body portion;

a connection hook coupled to a distal end of said connection chain such that said main body portion is adapted for coupling to a toy vehicle;

said runner having a bottom plate and pair of flanges extending upwardly from opposite sides of said bottom plate;

said flanges being positioned such that a longitudinal axis of each flange extends transversely to a longitudinal axis of said main body portion;

a forwardly positioned one of said flanges having a cutout portion for preventing contact between said connection chain and said forwardly positioned one of said flanges when said connection chain is in a tightened condition;

a simulated human operator positioned in said operator chair;

each of said weights having a protrusion extending from an upper surface of said weight for facilitating grasping of said weight;

a connection leg extending downwardly from said main body portion; and said runner being pivotally coupled to a distal end of said connection leg.

* * * * *